US010224604B2

(12) United States Patent
Kato

(10) Patent No.: US 10,224,604 B2
(45) Date of Patent: Mar. 5, 2019

(54) ANTENNA DEVICE AND COMMUNICATION TERMINAL DEVICE

(71) Applicant: Murata Manufacturing Co., Ltd., Nagaokakyo-shi, Kyoto-fu (JP)

(72) Inventor: Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 65 days.

(21) Appl. No.: 14/959,142

(22) Filed: Dec. 4, 2015

(65) Prior Publication Data

US 2016/0087330 A1 Mar. 24, 2016

Related U.S. Application Data

(63) Continuation of application No. PCT/JP2014/064666, filed on Jun. 3, 2014.

(30) Foreign Application Priority Data

Jun. 14, 2013 (JP) ..... 2013-125186

(51) Int. Cl.
*H01Q 1/24* (2006.01)
*H01Q 1/50* (2006.01)
(Continued)

(52) U.S. Cl.
CPC ..... *H01Q 1/243* (2013.01); *H01Q 1/22* (2013.01); *H01Q 1/48* (2013.01); *H01Q 1/50* (2013.01);
(Continued)

(58) Field of Classification Search
CPC ..... H01Q 1/243; H01Q 7/08; H01Q 1/48; H01Q 1/50; H01Q 1/22; H01Q 7/00
(Continued)

(56) References Cited

U.S. PATENT DOCUMENTS 7,924,235 B2 * 4/2011 Fujimoto ..... H01Q 1/22 343/787
2004/0090868 A1 * 5/2004 Endo ..... G04G 21/04 368/10
(Continued)

FOREIGN PATENT DOCUMENTS

| | | | |
|---|---|---|---|
| JP | 11-112226 | A | 4/1999 |
| JP | 4993045 | B2 | 8/2012 |
| JP | 2013-055637 | A | 3/2013 |
| JP | 5532191 | B1 | 6/2014 |
| WO | 2012/173080 | A1 | 12/2012 |

OTHER PUBLICATIONS

Official Communication issued in International Patent Application No. PCT/JP2014/064665, dated Aug. 5, 2014.

*Primary Examiner* — Hai Tran
(74) *Attorney, Agent, or Firm* — Keating & Bennett, LLP

(57) ABSTRACT

An antenna device includes two conductor surfaces at opposing positions with a space interposed between the conductor surfaces, a first connection conductor connecting the two conductor surfaces galvanically at one location, and an antenna coil arranged in proximity to the first connection conductor. The antenna coil is arranged at a position at which the antenna coil causes an induced current to flow through the first connection conductor by electromagnetic induction. Currents in the opposite directions flow through peripheral edge portions of the two conductor surfaces, so that a magnetic field is radiated from A space across which the two conductor surfaces oppose each other. This enables a conductor surface defined by a metal plate or the like to be used as a radiation element without providing a slit or an opening in the metal plate so as to avoid problems of a decrease in mechanical strength, design restrictions, and a decrease in an electric field shielding effect.

18 Claims, 5 Drawing Sheets

(51) Int. Cl.

| | |
|---|---|
| ***H01Q 1/48*** | (2006.01) |
| ***H01Q 1/22*** | (2006.01) |
| ***H01Q 7/08*** | (2006.01) |
| ***H01Q 9/04*** | (2006.01) |
| ***H01Q 21/29*** | (2006.01) |
| ***H01Q 7/00*** | (2006.01) |

(52) U.S. Cl.
CPC ..... *H01Q 7/00* (2013.01); *H01Q 7/08* (2013.01); *H01Q 9/0407* (2013.01); *H01Q 21/29* (2013.01)

(58) Field of Classification Search
USPC ..... 343/702, 767, 787
See application file for complete search history.

(56) References Cited

U.S. PATENT DOCUMENTS

2007/0285335 A1* 12/2007 Bungo ..... H01Q 1/243 343/895
2011/0287715 A1* 11/2011 Matsuura ..... H04B 5/0068 455/41.1
2012/0176282 A1* 7/2012 Kato ..... G06K 19/07749 343/702
2012/0262357 A1 10/2012 Kato et al.
2013/0207852 A1* 8/2013 Nakano ..... H01Q 1/2225 343/702
2014/0176382 A1 6/2014 Nakano et al.
2014/0203981 A1 7/2014 Nakano et al.

* cited by examiner

ANTENNA DEVICE AND COMMUNICATION TERMINAL DEVICE

BACKGROUND OF THE INVENTION

1. Field of the Invention

The present invention relates to an antenna device and a communication terminal device that are preferably used for a communication system using a high-frequency (HF) band or an ultra-high-frequency (UHF) band.

2. Description of the Related Art

In a device that is included in an electronic apparatus, such as a cellular phone, and performs HF-band communication, such as a near field communication (NFC), a radio-frequency integrated circuit (RFIC) and a matching element are typically mounted on a circuit substrate, an antenna is bonded to the inner side of a housing of the electronic apparatus, and the RFIC and the antenna are electrically connected to each other with a spring pin or the like interposed therebetween.

Meanwhile, a reduction in the thickness of a recent wireless communication terminal such as the cellular phone terminal has advanced, and "metallization" by applying magnesium plating to a housing and so on is performed in increasing cases in order to compensate for insufficient strength associated with such reduction in thickness.

However, when the "metallization" is performed on the terminal housing, an electromagnetic field around an antenna embedded in the terminal is shielded by metal. Due to the shielding of the electromagnetic field, there arises a problem that the antenna cannot make communication with a party-side antenna.

In order to solve the above problem, as disclosed in Japanese Patent No. 4993045, an antenna device having a configuration in which a metal plate having a larger area than an antenna coil proximate (magnetic field coupling) to the antenna coil and the metal plate is used as a radiator has been proposed.

By employing the antenna configuration disclosed in Japanese Patent No. 4993045, the antenna can make communication with a party-side antenna although the antenna is covered with metal. However, with provision of a slit or an opening in the metal plate, a decrease in the mechanical strength needs to be considered, and the number of processes in manufacturing increases. Further, when a slit or an opening is to be provided in a metal housing, in particular, design of the housing is restricted. In addition, the vicinity of the slit or the opening cannot be connected to the ground of a circuit. Therefore, the potential of the metal plate partially fluctuates in some cases, resulting in a problem that an electric field shielding effect of the metal plate decreases or a concern over interference of a first conductor surface and a second conductor surface with another high-frequency circuit is generated.

SUMMARY OF THE INVENTION

Preferred embodiments of the present invention provide an antenna device that prevents problems of a decrease in mechanical strength, design restrictions, and a decrease in electric field shielding effect, and that also significantly reduces or prevents the problem of interference with another high-frequency circuit, if necessary, by enabling a conductor surface defined by a metal plate or the like to be used as a radiation element without a slit or an opening provided in the metal plate, and also provide a communication terminal device including the antenna device.

An antenna device according to an aspect of various preferred embodiments of the present invention includes two conductor surfaces arranged at opposing positions with a space interposed between the conductor surfaces, a first connection conductor connecting the two conductor surfaces galvanically, or in terms of direct current at one location, and an antenna coil arranged in proximity to the first connection conductor, wherein the antenna coil is arranged at a position at which the antenna coil causes an induced current to flow through the first connection conductor by electromagnetic induction.

With this configuration, the induced current generated by the electromagnetic induction of the antenna coil flows through the connection conductor to which the antenna coil is arranged in proximity and currents in opposite directions flow through the two conductor surfaces. Therefore, the antenna device acts as an antenna that radiates a magnetic field from a space across which the two conductor surfaces oppose each other.

It is preferable that the antenna coil be arranged closer to a center of the two conductor surfaces than the first connection conductor is. With this configuration, a magnetic field generated by the antenna coil and a magnetic field radiated from the space across which the two conductor surfaces oppose each other do not cancel out each other.

It is preferable that the conductor surfaces include a conductor portion of a housing of an electronic apparatus. With this configuration, the housing also defines and functions as a portion of a radiation element.

It is preferable that the conductor surfaces include a ground electrode provided on a circuit substrate. With this configuration, the ground electrode on the circuit substrate defines and functions as a portion of the radiation element.

It is preferable that the conductor surfaces include a ground electrode provided on a circuit substrate and a conductor portion of a housing of an electronic apparatus, and the first connection conductor be a ground connection pin connecting the ground electrode and the conductor portion of the housing. With this configuration, the ground connection pin also defines and functions as the first connection conductor.

It is preferable that a second connection conductor connected to the two conductor surfaces with a capacitor interposed between the two conductor surfaces be further included, a carrier frequency of a communication signal be a frequency in an HF band, and the capacitor be an element of a low impedance at a frequency in a UHF band or higher. With this structure, when an antenna for the UHF band is provided in the same housing, a substrate current generated by the antenna for the UHF band is not easily influenced by the antenna coil and the antenna for the UHF band achieves predetermined antenna characteristics.

A communication terminal device according to another aspect of various preferred embodiments of the present invention includes an antenna device and a power supply circuit connected to the antenna device, wherein the antenna device includes two conductor surfaces arranged at opposing positions with a space interposed between the conductor surfaces, a first connection conductor connecting the two conductor surfaces galvanically at one location, and an antenna coil arranged in proximity to the first connection conductor, and the antenna coil is arranged at a position at which the antenna coil causes an induced current to flow through the first connection conductor by electromagnetic induction.

Various preferred embodiments of the present invention enables the two conductor surfaces to be used as radiation elements without providing a slit or an opening in a conductor surface. Therefore, problems of a decrease in mechanical strength, design restriction, and a decrease in an electric field shielding effect are prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
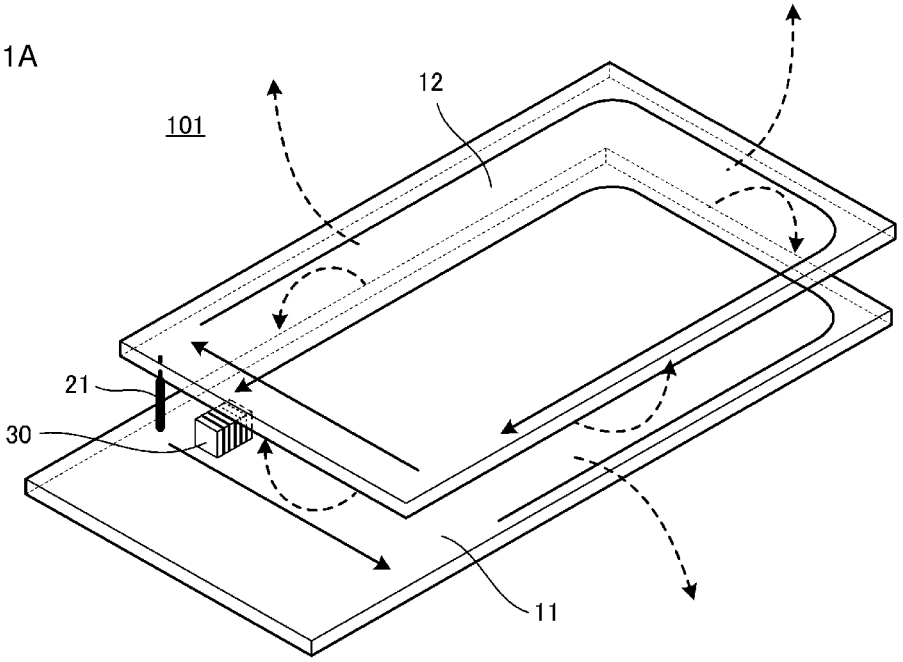
FIG. 1A is a perspective view of an antenna device 101 according to a first preferred embodiment of the present invention.

Hereinafter, a plurality of preferred embodiments of the present invention will be described using several specific examples with reference to the drawings. In the drawings, the same reference numerals denote the same portions. The preferred embodiments are illustrative and partial replacement or combination of configurations described in different embodiments can be made.

First Preferred Embodiment

Figure 1B:
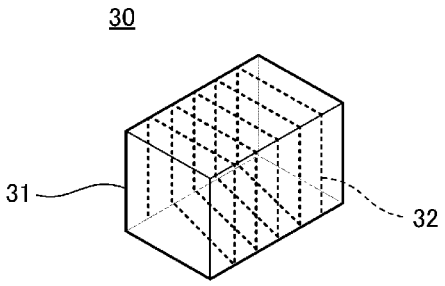
FIG. 1B is a perspective view of an antenna coil 30 provided in the antenna device 101.
Figure 2:
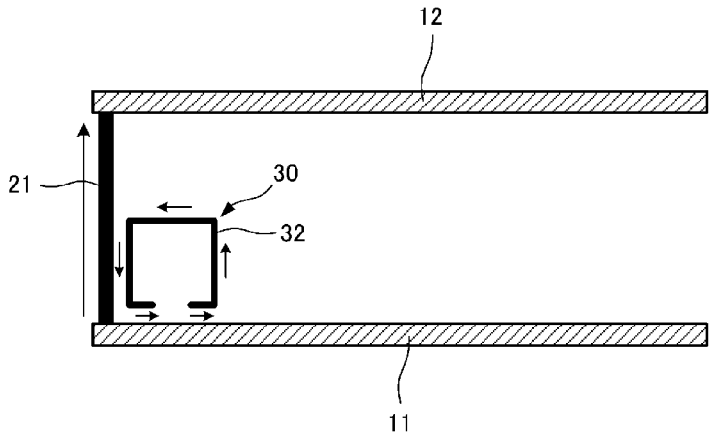
FIG. 2 is a front view of the antenna device 101.

FIG. 1A is a perspective view of an antenna device 101 according to a first preferred embodiment of the present invention, and FIG. 1B is a perspective view of an antenna coil 30 provided in the antenna device 101. FIG. 2 is a front view of the antenna device 101. The antenna device 101 preferably is an antenna that is used in an HF band of 13.56 MHz or the like, for example, and generates proximity-type or vicinity-type electromagnetic field coupling (magnetic field coupling, mainly) with an antenna of a communication party.

The antenna device 101 includes a first conductor surface 11 and a second conductor surface 12 opposing each other. The first conductor surface 11 and the second conductor surface 12 are connected with each other with a first connection conductor 21 (referred to as a "first" connection conductor in order to distinguish it from a second connection conductor, which will be described in another preferred embodiment later). The antenna coil 30 is arranged between the first conductor surface 11 and the second conductor surface 12 at a position in proximity to the first connection conductor 21. When the first connection conductor 21 and the antenna coil 30 are seen in an in-plane direction of the two conductor surfaces 11 and 12 from any point of view, the antenna coil 30 is arranged closer to the center of the conductor surfaces 11 and 12 than the first connection conductor 21 is. That is to say, the antenna coil 30 is arranged toward the inner side relative to the position of the first connection conductor 21 schematically.

As illustrated in FIG. 1B, the antenna coil 30 preferably includes a magnetic core 31 and a coil conductor 32, and the coil conductor 32 includes a pattern wound around the magnetic core 31. For example, coil conductor patterns are provided on a plurality of resin sheets containing magnetic ferrite fillers dispersed therein. The resin sheets are laminated and subjected to thermal pressure bonding so as to define a chip-type antenna in which a coil conductor in a rectangular or substantially rectangular helical form is embedded in a multilayer body. The antenna coil 30 may be a chip-type antenna defined by magnetic ferrite ceramics as a base body.

The antenna coil 30 is arranged in the vicinity of the first connection conductor 21 such that the portions of the coil conductor 32 included in the antenna coil 30 that are in proximity to the first connection conductor 21 are parallel or substantially parallel with the first connection conductor 21.

For example, the first conductor surface 11 is a ground electrode pattern of a circuit substrate. The second conductor surface 12 is a metal portion of a housing, for example. The first connection conductor 21 is a spring pin terminal and galvanically connects the first conductor surface 11 and the second conductor surface 12. The pin terminal is originally a ground connection pin that causes the metal portion of the housing and the ground electrode of the circuit substrate to have the same potential. In the present preferred embodiment, the pin terminal also defines and functions as a coupling portion that induces currents in the first conductor surface 11 and the second conductor surface 12, as will be described later.

As illustrated in FIG. 2, the coil conductor 32 of the antenna coil 30 and the first connection conductor 21 are in proximity to each other, so that the first connection conductor 21 and the portions of the coil conductor 32 that are in proximity thereto generate induction coupling to each other. That is to say, an induced current flows through the first connection conductor 21 in the direction opposite to the direction of a current flowing through the coil conductor 32 of the antenna coil 30.

Figure 3:
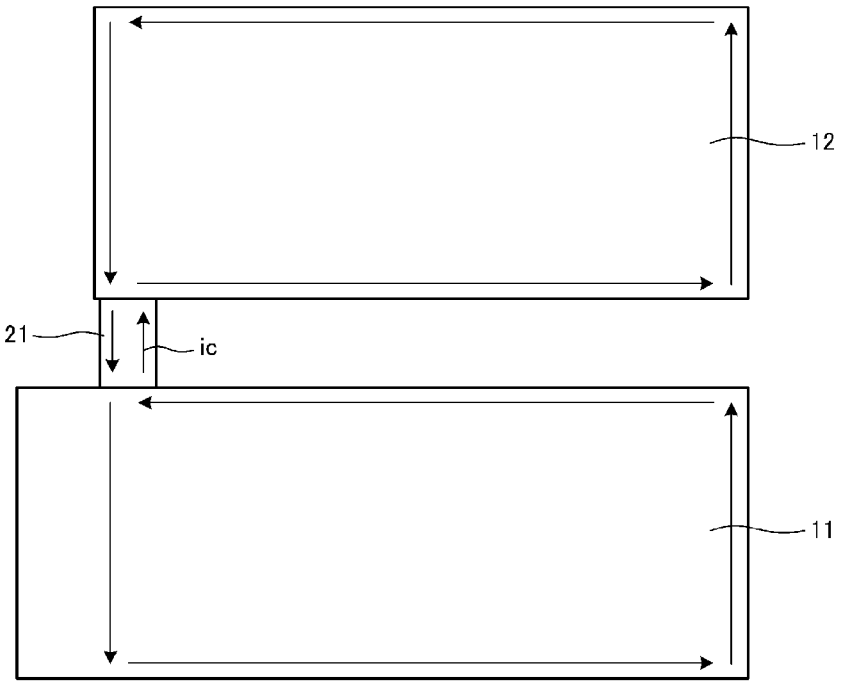
FIG. 3 is a development view illustrating an example of electric currents that are induced in a first conductor surface 11 and a second conductor surface 12.

FIG. 3 is a development view illustrating an example of currents that are induced in the first conductor surface 11 and the second conductor surface 12. This drawing is a view illustrating the two conductor surfaces 11 and 12 developed in a state in which they are connected with each other with the first connection conductor 21 interposed therebetween. When an induced current ic flows through the first connection conductor 21 by induction of the coil conductor 32 of the antenna coil 30, currents flow through the peripheral edge portions of the first conductor surface 11 and the second conductor surface 12 as indicated by arrows in FIG. 3.

As illustrated in FIG. 3, the currents flow through opposing portions of the two conductor surfaces 11 and 12 in the opposite directions. Therefore, a magnetic field is radiated from a space across which the two conductor surfaces 11 and 12 oppose each other. Dashed arrows in FIG. 1 indicate directions of the radiated magnetic field with magnetic field lines.

As described above, the antenna coil 30 is arranged toward the inner side relative to the position of the first connection conductor 21. Therefore, the magnetic field that is radiated from the space across which the two conductor surfaces 11 and 12 oppose each other and the magnetic field that is radiated from the antenna coil 30 have the same polarity. In other words, these magnetic fields are not cancelled out by each other.

Second Preferred Embodiment

Figure 4:
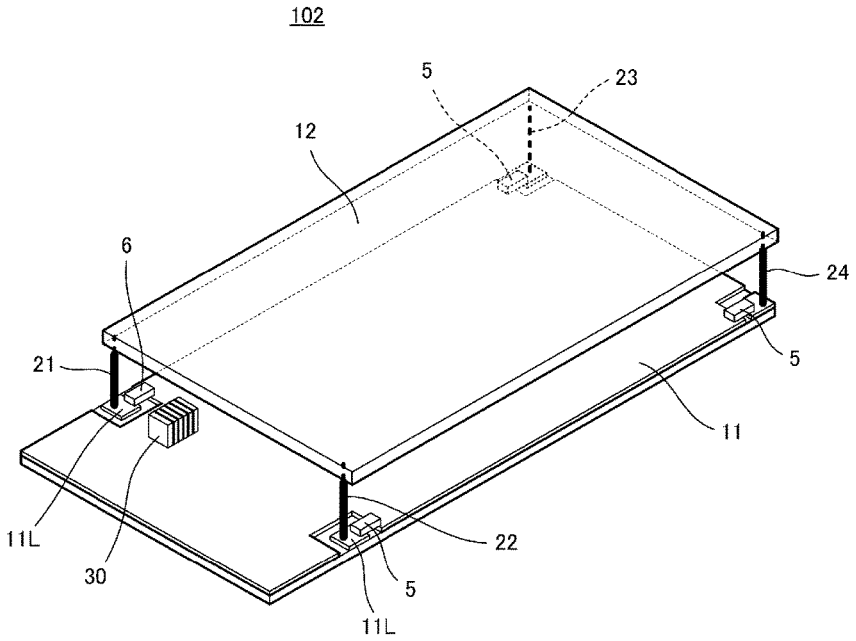
FIG. 4 is a perspective view of an antenna device 102 according to a second preferred embodiment of the present invention.

FIG. 4 is a perspective view of an antenna device 102 according to a second preferred embodiment of the present invention. The antenna device 102 includes the first connection conductor 21 and a plurality of second connection conductors 22, 23, and 24. These connection conductors 21 to 24 are located at the edges of the first conductor surface 11 and the second conductor surface 12. The first connection conductor 21 allows a land 11L and the second conductor surface 12 to become conductive. A chip inductor 6 is mounted between the land 11L and the first conductor surface 11. That is to say, the first conductor surface 11 and the second conductor surface 12 are connected with each other with the chip inductor 6 interposed therebetween at a portion around the first connection conductor 21.

The second connection conductor 22 allows a land 11L and the second conductor surface 12 to become conductive. A chip capacitor 5 is mounted between the land 11L and the first conductor surface 11. That is to say, the first conductor surface 11 and the second conductor surface 12 are connected with each other with the chip capacitor 5 interposed therebetween at a portion around the second connection conductor 22. At portions around the second connection conductors 23 and 24, the first conductor surface 11 and the second conductor surface 12 are connected with each other with chip capacitors 5 interposed therebetween in the same manner.

The above-mentioned chip capacitors 5 are elements of high impedances in a frequency band (HF band) of a carrier frequency of a communication signal but of low impedances at a frequency in the UHF band or higher. Therefore, in the HF band, the portions at the connection conductors 22, 23, and 24 are galvanically in an open state and operate in the same manner as in the antenna device 101 described in the first preferred embodiment. At the frequency in the UHF band or higher, the portions at the connection conductors 22, 23, and 24 are in a connecting state in a high-frequency manner and ground connection is made at these portions reliably. Therefore, the two conductor surfaces 11 and 12 are overall at the stable ground potential.

Further, the first conductor surface 11 and the second conductor surface 12 are connected with each other with the chip inductor 6 interposed therebetween at the portion around the first connection conductor 21, so that the first conductor surface 11 and the second conductor surface 12 are directly connected in a high-frequency manner at the portion around the first connection conductor 21 in the HF band and a current is suppressed in the UHF band. Accordingly, a substrate current by an antenna for the UHF band does not flow through the first connection conductor 21 and has little influence on the ferrite of the antenna coil 30. With this, antenna characteristics of the UHF band are maintained.

Third Preferred Embodiment

Figure 5:
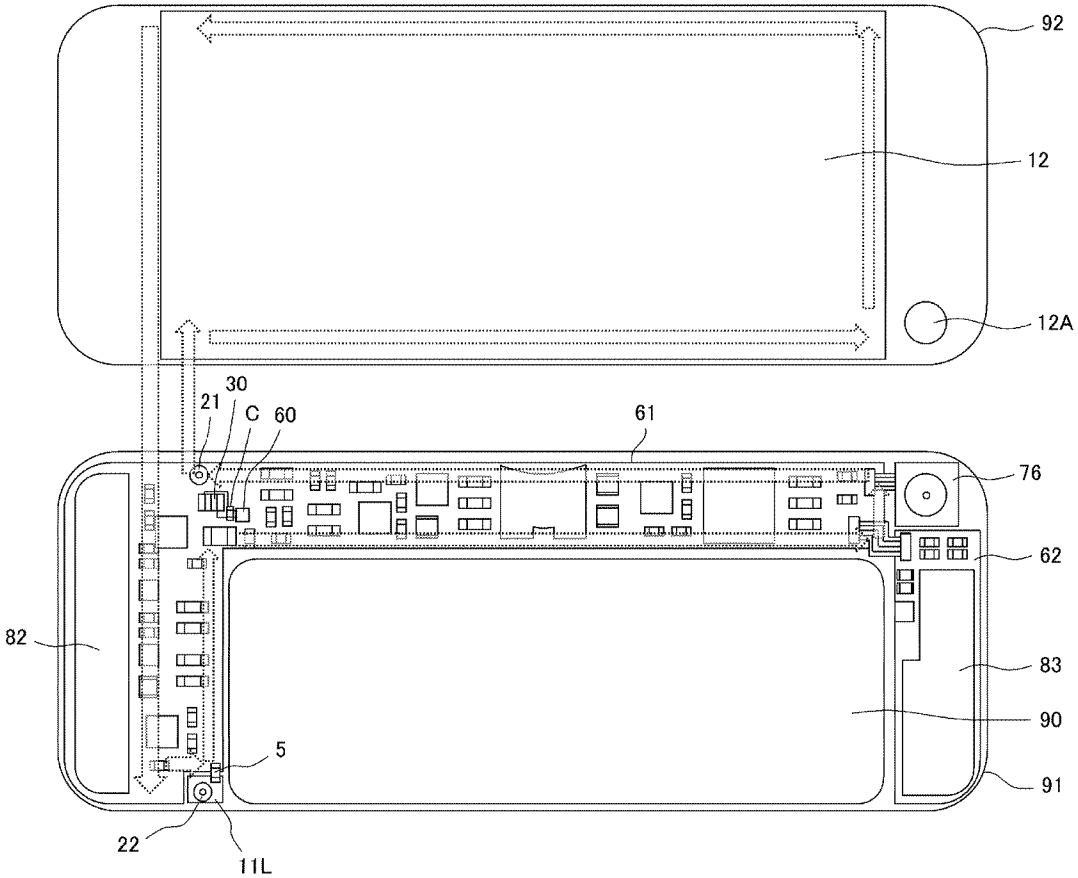
FIG. 5 is a plan view illustrating a configuration of an inner portion of a communication terminal device according to a third preferred embodiment of the present invention.

FIG. 5 is a plan view illustrating a configuration of an inner portion of a communication terminal device according to a third preferred embodiment of the present invention. Circuit substrates 61 and 62, a battery pack 90, a camera module 76, and so on are accommodated in an upper housing 91. An RFIC 60 including a communication circuit, a resonance capacitor C, the antenna coil 30, and so on are mounted on the circuit substrate 61. A main UHF-band antenna 82 and so on are also provided on the circuit substrate 61. Further, a sub UHF-band antenna 83 and so one are provided on the circuit substrate 62. A circuit on the circuit substrate 61 and a circuit on the circuit substrate 62 are connected with each other with a cable interposed therebetween. The UHF-band antennas 82 and 83 are provided by mounting chip antennas, forming line patterns, or the like.

A ground electrode is provided on substantially an overall area of the circuit substrate 61, and the ground electrode defines and functions as a first conductor surface. A lower housing 92 is made of resin and the second conductor surface 12 defined by a metal film is provided on the inner surface of the lower housing 92. The metal film may be formed by bonding an aluminum foil or a copper foil to the inner side of the lower housing 92 or may be formed by drawing it on the inner side of the lower housing 92 with a laser direct structuring (LDS) technology or the like. Further, the metal film preferably occupies an area equal to or larger than half the area of the main surface of the circuit substrate 61 in order to also define and function as a shield for various components mounted on the circuit substrate 61 and so on. In this example, substantially the overall area other than the regions occupied by the main antenna 82 and the sub antenna 83 is shielded by the metal film. An opening 12A is provided in the lower housing 92. A lens of the camera module 76 is arranged so as to be optically exposed through the opening 12A.

The first connection conductor 21 is mounted on the ground electrode of the circuit substrate 61. The connection conductor 22 is mounted on the land 11L. The chip capacitor 5 is mounted between the land 11L and the ground electrode.

FIG. 5 illustrates currents flowing through the first conductor surface (ground electrode formed on the circuit substrate 61) 11 and the second conductor surface (metal portion of the housing) 12 by thick arrows.

Figure 6:
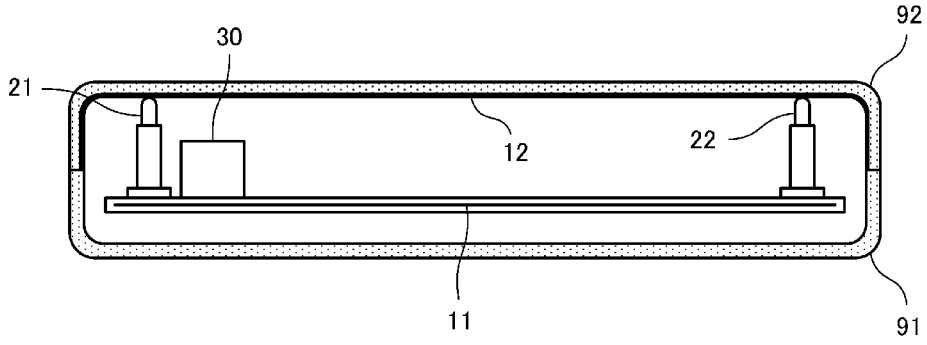
FIG. 6 is a cross-sectional view cut at positions passing through a first connection conductor 21 and a second connection conductor 22.

FIG. 6 is a cross-sectional view cut at positions passing through the first connection conductor 21 and the second connection conductor 22. As in the antenna device illustrated in FIG. 1A in the first preferred embodiment, a current flows through the first conductor surface (ground electrode formed on the circuit substrate 61) 11 and the second conductor surface (metal portion of the housing) 12. Thus, the two conductor surfaces 11 and 12 and the space across which they oppose each other define and function as radiation elements.

As illustrated in FIG. 5, the first conductor surface (ground electrode) 11 and the second conductor surface (metal portion of the housing) 12 are not required to oppose each other on the overall surfaces and may partially oppose each other.

The above-described preferred embodiments are illustrative and the present invention is not limited to these preferred embodiments. The antenna coil 30 and the RFIC 60 may be integrated for modularization. With this configuration, electric conduction between the RFIC and the power supply coil does not need to be made by wiring of a substrate, such as a circuit substrate, and the degree of freedom in a mounting space is enhanced.

Further, one of the first conductor surface and the second conductor surface according to various preferred embodiments of the present invention is not limited to be the ground electrode provided on the circuit substrate. In addition, one of the first conductor surface and the second conductor surface is not limited to be the metal portion of the housing. For example, a shield case, a shield plate, a battery pack, a liquid-crystal display (LCD) panel, or the like may be used as the first conductor surface or the second conductor surface.

Although FIG. 1A and so on illustrate the planar first conductor surface 11 and the planar second conductor surface 12, the shape of the second conductor surface 12 is not limited thereto. The second conductor surface may be a metal portion of the housing accommodating the circuit substrate. In addition, the metal portion of the housing may be a molded product of the metal plate.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

two conductor surfaces arranged at opposing positions with a space interposed between the two conductor surfaces;

a first connection conductor directly connecting the two conductor surfaces galvanically at one location; and an antenna coil arranged in proximity to the first connection conductor; wherein the antenna coil is arranged at a position in proximity to the first connection conductor such that the antenna coil causes an induced current to flow through the first connection conductor by electromagnetic induction;

the antenna coil is not galvanically connected to any of the first connection conductor and the two conductor surfaces; and a winding axis of the antenna coil is parallel or substantially parallel with at least one of the two conductor surfaces.

2. The antenna device according to claim 1, wherein the antenna coil is located closer to a center of the two conductor surfaces than the first connection conductor is.

3. The antenna device according to claim 1, wherein the two conductor surfaces include a conductor portion of a housing of an electronic apparatus.

4. The antenna device according to claim 1, wherein the two conductor surfaces include a ground electrode located on a circuit substrate.

5. The antenna device according to claim 1, wherein the two conductor surfaces include a ground electrode located on a circuit substrate and a conductor portion of a housing of an electronic apparatus, and the first connection conductor is a ground connection pin connecting the ground electrode and the conductor portion of the housing.

6. The antenna device according to claim 5, further comprising:

a second connection conductor connected to the two conductor surfaces with a capacitor interposed between the two conductor surfaces; wherein a carrier frequency of a communication signal is a frequency in an HF band, and the capacitor is an element of a lower impedance at a frequency in a UHF band or a higher frequency, than an impedance at the frequency in the HF band.

7. The antenna device according to claim 1, wherein the antenna device is configured for use an HF band of 13.56 MHz.

8. The antenna device according to claim 1, wherein the antenna coil includes a magnetic core and a coil conductor including a pattern wound around the magnetic core.

9. The antenna device according to claim 8, wherein portions of the coil conductor included in the antenna coil that are in proximity to the first connection conductor are parallel or substantially parallel with the first connection conductor.

10. The antenna device according to claim 1, wherein the antenna coil is a chip antenna.

11. The antenna device according to claim 1, further comprising a plurality of second connection conductors located at edges of the two conductor surfaces.

12. The antenna device according to claim 1, further comprising a chip inductor connected to the two conductor surfaces.

13. The antenna device according to claim 12, further comprising a chip capacitor connected to the two conductor surfaces.

14. The antenna device according to claim 1, wherein the winding axis of the antenna coil is perpendicular or substantially perpendicular to a direction in which the first connection conductor extends.

15. A communication terminal device comprising:

an antenna device; and a power supply circuit connected to the antenna device; wherein the antenna device includes:

two conductor surfaces arranged at opposing positions with a space interposed between the two conductor surfaces;

a first connection conductor directly connecting the two conductor surfaces galvanically at one location; and an antenna coil arranged in proximity to the first connection conductor;

the antenna coil is located at a position in proximity to the first connection conductor such that the antenna coil causes an induced current to flow through the first connection conductor by electromagnetic induction;

the antenna coil is not galvanically connected to any of the first connection conductor and the two conductor surfaces; and a winding axis of the antenna coil is parallel or substantially parallel with at least one of the two conductor surfaces.

16. The communication terminal device according to claim 15, further comprising a camera module and an RFIC.

17. The communication terminal device according to claim 16, wherein the antenna coil and the RFIC are integrated in a single module.

18. The communication terminal device according to claim 15, wherein the winding axis of the antenna coil is perpendicular or substantially perpendicular to a direction in which the first connection conductor extends.

* * * * *